US005217406A

United States Patent [19]

Toth et al.

[11] Patent Number: 5,217,406

[45] Date of Patent: Jun. 8, 1993

[54] MINE VENTILATION TUBING SYSTEM AND METHOD OF INSTALLATION

[75] Inventors: Mick E. Toth, Morgantown; Robert R. McGill, Rivesville, both of W. Va.

[73] Assignee: Peabody Coal Company, St. Louis, Mo.

[21] Appl. No.: 852,762

[22] Filed: Mar. 17, 1992

[51] Int. Cl.[5] ..... E21F 1/04

[52] U.S. Cl. ..... 454/172

[58] Field of Search ..... 454/168, 171, 172, 306, 454/903

[56] References Cited

U.S. PATENT DOCUMENTS

| | | | |
|---|---|---|---|
| 787,613 | 4/1905 | D'Esposito | 138/161 |
| 1,508,347 | 9/1924 | Montreuil | 138/157 |
| 2,123,410 | 7/1938 | Fawcett | 138/159 |
| 2,483,704 | 10/1949 | Leigh | 138/160 |
| 2,801,065 | 7/1957 | Moir et al. | 248/120 |
| 4,011,726 | 3/1977 | Cooper, Jr. | 138/177 X |
| 4,235,163 | 11/1980 | Divers | 454/172 |
| 4,530,865 | 7/1985 | Sprenger | 138/166 X |

FOREIGN PATENT DOCUMENTS

| | | | |
|---|---|---|---|
| 296794 | 1/1888 | Fed. Rep. of Germany | 454/168 |
| 2918058 | 11/1980 | Fed. Rep. of Germany | 138/DIG. 11 |
| 483553 | 9/1975 | U.S.S.R. | 454/168 |
| 4054 | 10/1980 | United Kingdom | 138/DIG. 11 |

*Primary Examiner*—Harold Joyce

*Attorney, Agent, or Firm*—Senniger, Powers, Leavitt & Roedel

[57] ABSTRACT

Mine ventilation tubing system for use in a mine tunnel including a plurality of tubing sections having, in transverse cross section, three sides connected together by three radiused corners, one of the corners having a substantially larger radius than the other two corners. A mounting assembly mounts the tubing sections in the tunnel with the one corner having the larger radius located closely adjacent the intersection of one of the side walls with the ceiling of the tunnel. In its mounted position, a first of the tubing section sides is located closely adjacent the ceiling, and a second of the tubing section sides is located closely adjacent the side wall such that the tubing sections are positioned out of the way of equipment travelling or operating in the tunnel.

24 Claims, 3 Drawing Sheets

3
3
2
2
20
44
18
28
26
58
54
50
52
5
54
48
C
R3
48
48A
12
16
R2
48B
14
R1
48C
51
56
64
60
66
62
56

MINE VENTILATION TUBING SYSTEM AND METHOD OF INSTALLATION

BACKGROUND OF THE INVENTION

This invention relates to mine ventilation systems and more particularly to a mine ventilation tubing system and method of installing the same.

In underground mining operations air under pressure is forced into the mine tunnels to ventilate the tunnels. Presently, the pressurized air is transported into the tunnels in fiberglass tubing which are generally oval in cross section. The tubing is supported from the mine tunnel ceiling directly above the tubing, and hangs down into the mine tunnel. The present tubing is unsatisfactory in certain applications where higher than ordinary air pressure is required because the tubing tends to collapse in the middle. The tubing is also frequently damaged by being struck by mining equipment travelling through or operating in the relatively confined space in the tunnel. In order to be large enough to permit the required volume flow of air, the tubing tends to protrude into the mine ventilation tunnel, where it reduces work space and is more likely to be damaged. Thus, there is presently a need for a mine ventilation tubing system which can transport air under higher pressures and which is less obtrusive in the mine tunnel.

SUMMARY OF THE INVENTION

Among the several objects and features of the present invention may be noted the provision of a mine ventilation tubing system which does not substantially protrude into the work area in a mine tunnel; the provision of such a tubing system which is lightweight and yet is capable of transporting high pressure air without failure of the tubing; the provision of such a tubing system which can be easily installed in the mine tunnel; and the provision of such a tubing system which can be easily taken down.

Generally, a mine ventilation tubing system constructed according to the principles of the present invention comprises a plurality of tubing sections having, in transverse cross section, three sides connected together by three radiused corners, one of the corners having a substantially larger radius that the other two corners. Means mounts the tubing sections in the tunnel with the one corner having the larger radius located closely adjacent the intersection of one of the tunnel side walls with the ceiling. A first of the tubing section sides is located closely adjacent the ceiling, and a second of the tubing section sides is located closely adjacent the one side wall such that the tubing sections are positioned out of the way of equipment travelling or operating in the tunnel.

A method of installing the tubing system is also disclosed.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figures 1, 5:
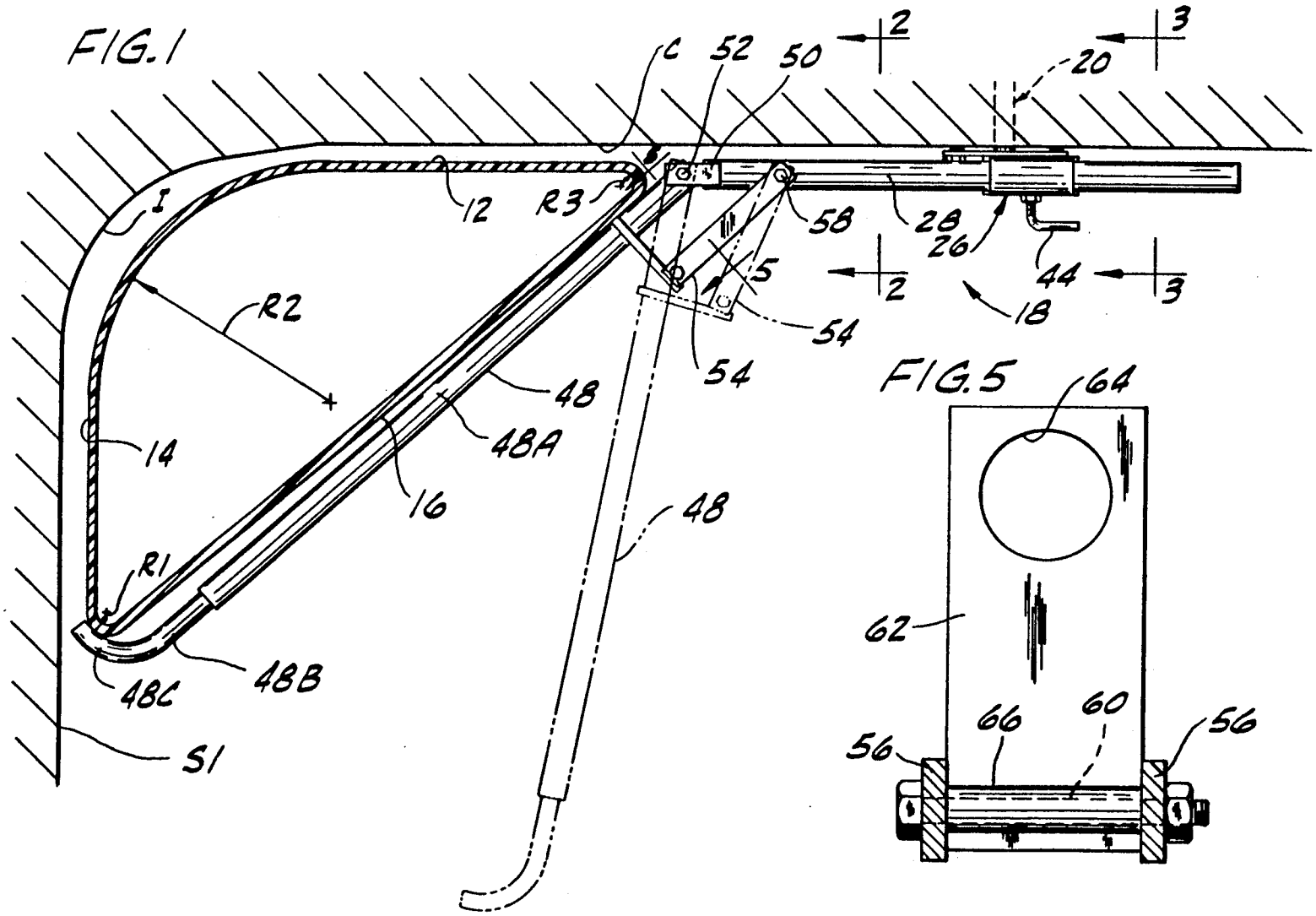
FIG. 1 is a tubing system as installed in a mine tunnel showing a tubing section of the system in cross section.
FIG. 5 is a section taken along line 5—5 of FIG. 1 with portions of the tubing system removed for clarity.
Figure 3:
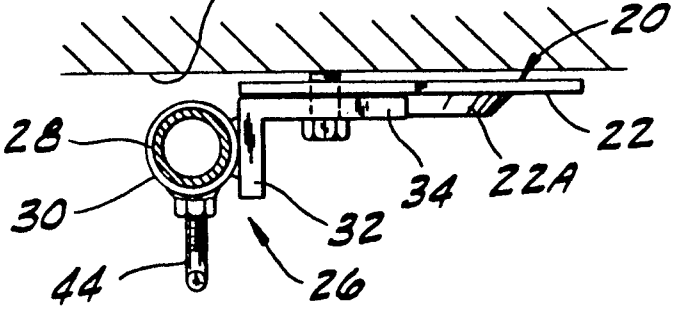
FIG. 3 is a view of a hanger assembly of the tubing system seen as indicated by line 3—3 of in FIG. 1 with portions removed for clarity.
Figure 4:
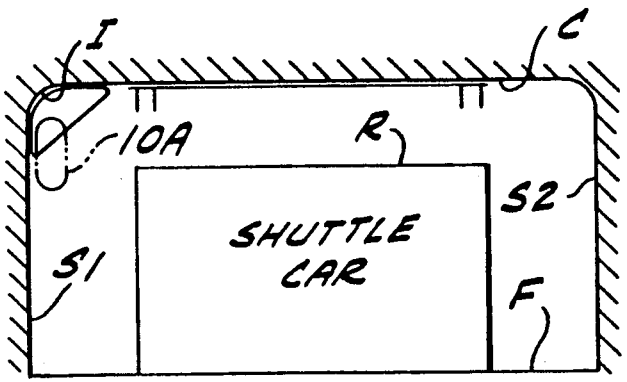
FIG. 4 is a schematic of a mine tunnel showing the tubing system of the present invention and a prior art tubing system in phantom.

Referring now to the drawings, a mine ventilation tubing system of the present invention is shown to comprise a plurality of tubing sections, such as tubing section seen in cross section in FIG. 1 and generally indicated by the reference numeral 10. As shown in FIG. 4, the tubing system is adapted for use in a mine tunnel having a ceiling C, a floor F and side walls indicated at S1 and S2, respectively, extending upwardly from the floor and intersecting the ceiling at a curved intersection I. A tubing section 10 of the present invention is shown as mounted in the tunnel in FIG. 4, and an existing tubing section 10A having an oval cross section is shown in phantom as mounted in the tunnel. In the illustrated embodiment, the cross sectional area of the tubing section 10 is significantly larger than the existing tubing section 10A (i.e., approximately 1.8 square feet to 1.45 square feet) and can carry a greater volume of air but is located out of the way of men and equipment travelling or working in the tunnel. If the tubing section 10 is made with a cross sectional area substantially equal to the existing tubing section 10A, the space savings in the tunnel is even greater than illustrated in FIG. 4.

The tubing section 10 is generally triangular in cross section and has first, second and third sides, indicated at 12, 14 and 16, respectively, connected together by three corners having radiuses R1, R2 and R3, respectively, with the radius R2 being substantially larger than the radiuses R1 and R3. The tubing section 10 is preferably made of fiberglass, but may be made of other materials and still fall within the scope of the present invention. In the preferred embodiment, the first side 12 and second side 14 are of substantially the same length, and the radiuses R1 and R3 are preferably in a range of about 0.08 inches and 0.25 inches, but the radiuses may be outside this range and still fall within the scope of the present invention. The larger radius R2 preferably is in a range of about 0.8 inches to 1 foot, but again the tubing may have other radiuses R2 larger than R1 and R2 and still fall within the scope of the present invention. The precise radiuses may be dictated to some extent by manufacturing considerations.

A hanger assembly (broadly "mounting means") indicated generally at 18, mounts the tubing section 10 in the tunnel with the corner having the larger radius R2 located closely adjacent the intersection I of the side wall S1 and the ceiling C, the first side 12 of the tubing section located closely adjacent the ceiling in a plane generally parallel to the plane of the ceiling, and the second side 14 of the tubing section located closely adjacent the side wall in a plane generally parallel to the plane of the side wall. The plane of the second side 14 of the tubing section is generally perpendicular to the plane of the first side 12 of the tubing section, and the third side 16 lies generally in a plane intersecting the planes of the first and second sides at oblique angles.

The tubing sections 10 of the present invention are supported by the hanger assembly 18 in cantilever fashion from the side rather tan being hung from locations directly above the tubing section as with presently existing designs. The hanger assembly 18 includes a roof bolt, generally indicated at 20, which is secured in the tunnel ceiling C adjacent to the intersection I of the side wall S1 and ceiling of the tunnel where the tubing section 10 is to be positioned. A mounting plate 22 at the lower end of the roof bolt 20 and forming part of the roof bolt is adapted for connection to a sleeve, indicated generally at 26, and a support arm 28 (the sleeve and support arm together constituting the "mounting member" in this embodiment). The mounting plate 22 is generally square in plan with a depending central dished portion 22A. The sleeve 26 includes a tube 30 attached such as by welding to a first flange 32 of an angle bar. A second flange 34 of the angle bar has a C-shaped opening 36 at its edge opposite the first flange, and a pair of holes (not shown) spaced longitudinally of the second flange of one another. The C-shaped opening 36 is adapted to receive a part of the dished portion 22A of the mounting plate. Corresponding holes (not shown) in the mounting plate 22 are aligned with the holes in the second flange 34 of the angle bar and fasteners 42 are received through the aligned openings for connecting the sleeve 26 to the mounting plate.

The support arm 28 is slidably received through the tube 30 of the sleeve for selective adjustment relative the tube generally toward and away from the side wall S1. A generally L-shaped set pin 44 is threadably engaged in an opening in the underside of the tube 30. The "L" shape of the set pin 44 facilitates grasping and turning the pin in a first direction in which the pin engages the support arm 28 in the tube 30 and holds it from movement relative the tube, and in a second direction in which the pin is disengaged from the support arm and allows sliding movement of the support arm lengthwise in the tube.

A cradle member indicated in its entirety by the reference numeral 48 is pivotally attached to the support arm 28 by a bracket 50 fixed at the end of the support arm 28 and a first hinge pin 52 received through openings (not shown) in the bracket and cradle member. The cradle member 48 can swing relative the support arm 28 between a retracted position (shown in phantom in FIG. 1) in which the cradle member is spaced from the intersection I, and a support position (shown in solid lines in FIG. 1) in which the cradle member is closer to the intersection. In the preferred embodiment, the roof bolt 20 and mounting plate 22 are part of the pre-existing mine tunnel ceiling support structure. In that instance, the hanger assembly 18 includes only the sleeve 26, support arm 28 and cradle member 48. Locking means, comprising in this embodiment a locking brace indicated generally at 54, is adapted to releasably lock the cradle member 48 in its support position for holding the tubing section 10 closely adjacent the mine tunnel ceiling C and side wall S1 at the intersection I. In the illustrated embodiment, the cradle member 48 is formed from an upper section 48A of one inch black steel pipe and a lower section 48B of one-half inch black steel pipe which has been formed with a hook-shaped portion 48C at its distal end. A portion of the lower section 48B of one-half inch pipe is received in the upper section 48A and fixed such as by welding therein. As may be seen in FIG. 1, the hook-shaped portion 48C of the cradle member engages and retains the lower end of the tubing section 10.

Figure 2:
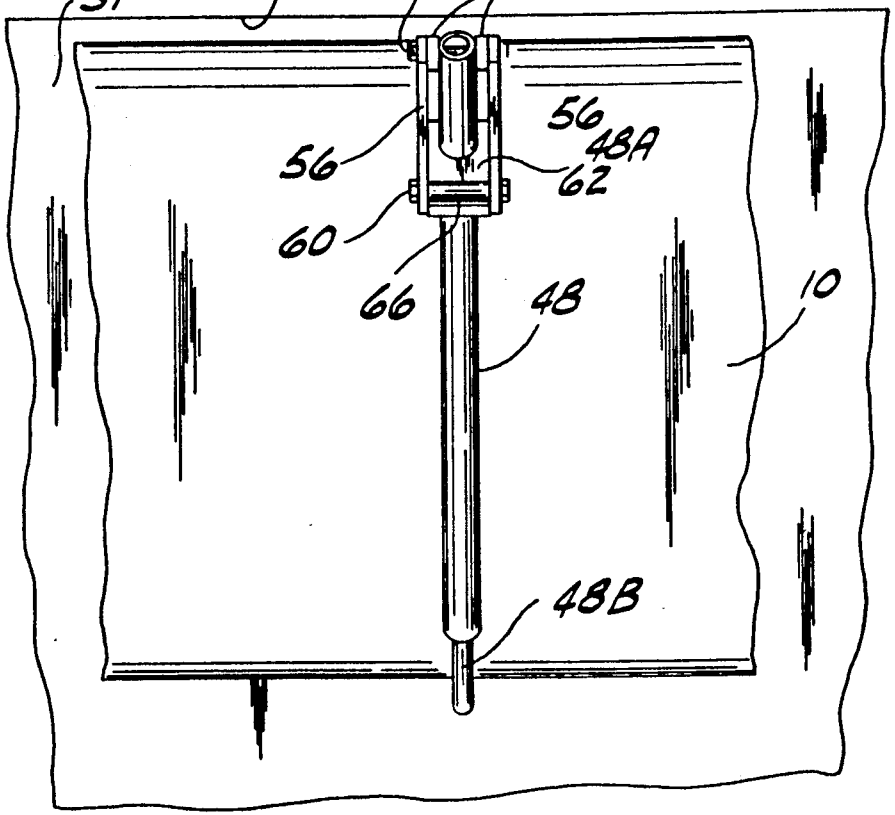
FIG. 2 is a fragmentary elevation of the tubing system seen as indicated by line 2—2 in FIG. 1 with portions removed for clarity.
Figure 6:
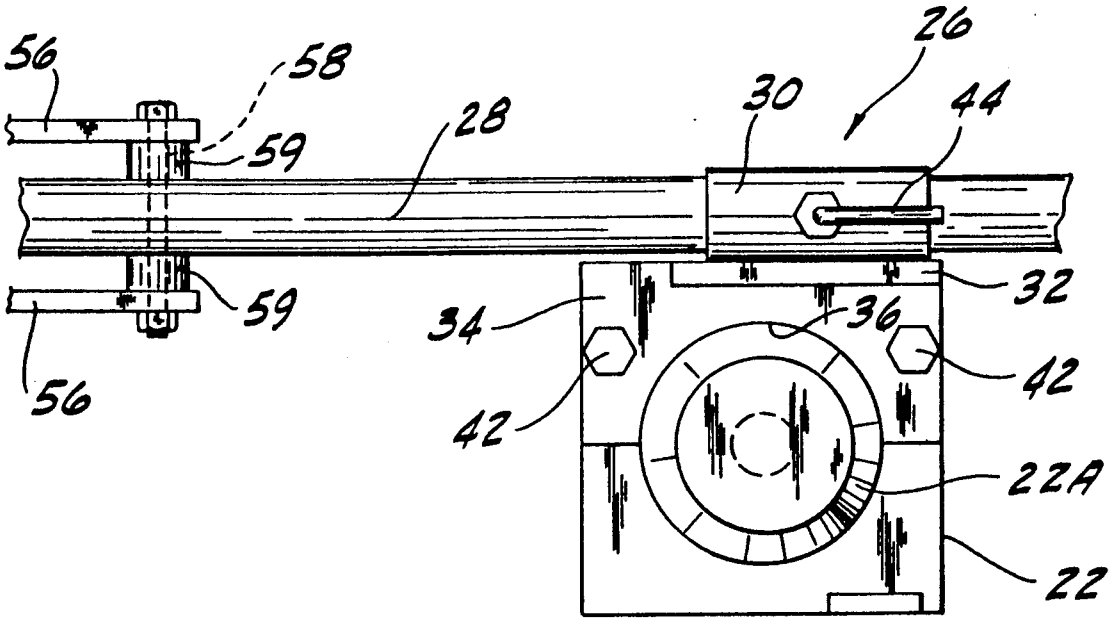
FIG. 6 is a bottom plan view of a mounting member of the tubing system.

The locking brace 54 includes a pair of legs 56 pivotally attached by a second hinge pin 58 to the support arm 28 at a location inward of the pivotal connection of the cradle member 48 to the support arm 28. The legs 56 extend generally downwardly from either side of the support arm 28 and are spaced from the support arm by bushings 59. The legs 56 are pivotally connected by a third hinge pin 60 to a locking foot 62 extending generally laterally from the legs toward the side wall S1. As shown in FIG. 5, the foot 62 has an opening 64 generally at its distal end and a sleeve 66 mounted as by welding on the foot at the proximal end which receives the third hinge pin 60. The cradle member 48 and tubing section 10 are not shown in FIG. 5 so that the structure of the locking brace 54 may be more clearly seen. As shown in FIG. 2, the upper section 48A of the cradle member 48 is received through the opening 64 in the foot. The diameter of the opening 64 is larger (e.g., one and 11/32 inch) than the one inch diameter of the upper section 48A, which allows the foot 62 to be pivoted along a small arc on the third hinge 60. The locking brace 54 is swingable with the cradle member 48 between its retracted and support positions. To lock the cradle member 48 in its support position (shown in solid lines in FIG. 1) the locking foot 62 is pivoted on the third hinge 60 so that the periphery of the opening 64 wedges against the upper section 48A to hold the cradle member 48 and locking brace 54 from the pivoting back to the retracted position.

To install the ventilation tubing system, roof bolts 20 and mounting plates 22 adjacent the side wall S1 and intersection I and forming a part of the existing tunnel ceiling support structure are used. The sleeve 26 is attached to the mounting plate 22 of the roof bolt 20 with a pair of threaded fasteners 42 which are received through aligned openings in the second flange 34 of the sleeve and mounting plate 22. The support arm 28 is received in the tube 30 and slid laterally of the tunnel in the tube until the cradle member 48 is positioned a distance from the side wall S1 which will result in the tubing section 10 being supported closely adjacent the side wall and ceiling in the intersection.

A tubing section 10 is inserted between the side wall S1 and the cradle member 48 and temporarily held in position. The cradle member 48 and locking brace 54 are swung from the retracted position upwardly into the support position, and the locking foot 62 is canted relative to the cradle member 48 by manually pivoting the foot on the third hinge 60 so that the cradle member engages the foot at the periphery of the opening 64. The weight of the tubing section 10 is supported by the cradle member 48 with the locking brace 54 preventing the cradle member from pivoting back to the retracted position. In its fully installed position, the tubing section 10 is spaced only a few inches (e.g., 3 inches or less) from the ceiling C, whereas existing systems hang the tubing sections 10 approximately 8 to 9 inches from the ceiling. The tubing section 10 may later be easily released by swinging the cradle member 48 and locking brace 54 upwardly and realigning the opening 64 in the locking foot 62 with the central longitudinal axis of the cradle member by pivoting the foot on the third hinge 60 so that both may be then swung down to the retracted position away from the tubing section. The tubing sections are connected together in a conventional fashion such as by having one end portion (not shown) of reduced cross sectional area which is slidably received in the open end of the adjacent tubing section.

Thus, it may be seen that the several objects of the present invention are achieved and other advantageous features met in the disclosed embodiment. The tubing sections 10 which are generally triangular in shape fit the contour of the tunnel at the intersection I and thus, may be positioned closely adjacent the side wall S1 and ceiling C so that the tubing section is out of the way of men and machinery in the mine tunnel. In addition, the triangular cross section tubing is of greater strength that the presently existing oval cross section tubing. As it becomes necessary to force air under higher pressures into the mine, the oval cross section tubing tends to collapse. However, the extra corners in the triangular cross section tubing gives additional strength so that air under higher pressures may be transported through the tubing without failures. The additional strength is achieved while making the tubing less obtrusive into the tunnel than existing tubing.

The hanger assembly 18 of the present invention uses a cantilever arrangement which allows the tubing section 10 to be held closer to the ceiling than in existing tubing systems which hinge the tubing sections (i.e., section 10A) from the ceiling at locations direction above the tubing. Moreover, the unique locking brace 54 allows the cradle member 48 to be quickly and easily locked in its support position without fasteners to be tightened. If it is later necessary to unlock the cradle member 48, this can be easily accomplished by simply pushing the cradle member upward and realigning the opening 64 in the locking foot 62 with the cradle member and swinging the cradle member and locking brace 54 back to the retracted position.

As various changes could be made in the above constructions without departing from the scope of the invention, it is intended that all matter contained in the above description or shown in the accompanying drawings shall be interpreted as illustrative and not in a limiting sense.

What is claimed is:

1. A mine ventilation tubing system for use in a mine tunnel having a ceiling, a floor and side walls extending upwardly from the floor and intersecting the ceiling, the tubing system comprising:

a plurality of tubing sections having, in transverse cross section, three sides connected together by three radiused corners, one of said corners having a substantially larger radius than the other two corners;

means mounting the tubing sections in the tunnel with said one corner having the larger radius located closely adjacent the intersection of one of the side walls with the ceiling, a first of said tubing section sides located closely adjacent the ceiling, and a second of said tubing section sides located closely adjacent said one side wall such that the tubing sections are positioned out of the way of equipment travelling or operating in the tunnel.

2. A mine ventilation tubing system as set forth in claim 1 wherein said first side of each tubing section lies in a plane generally perpendicular to a plane including said second side of the tubing section.

3. A mine ventilation tubing system as set forth in claim 2 wherein a third side of the tubing section lies in a plane intersecting the planes of said first and second sides of the tubing section at oblique angles.

4. A mine ventilation tubing system as set forth in claim 3 wherein said mounting means is adapted to mount the tubing section with the Plane of said first side extending generally parallel to the ceiling and the plane of said second side extending generally parallel to said one side wall.

5. A mine ventilation tubing system as set forth in claim 4 wherein the tubing sections are made of fiberglass.

6. A mine ventilation tubing system as set forth in claim 2 wherein the length of said first ventilation tubing section side is substantially equal to the length of said second ventilation tubing section side.

7. A mine ventilation tubing system as set forth in claim 1 wherein said mounting means comprises cantilever support means mounted on the mine tunnel for supporting the tubing sections in cantilever fashion.

8. A mine ventilation tubing system as set forth in claim 7 wherein said cantilever support means comprises a plurality mounting members fixed to the mine tunnel, and a plurality of cradle members pivotally attached to corresponding mounting members for swinging between a retracted position in which each cradle member is spaced from the intersection of the ceiling and said one side wall to allow positioning of one of the tubing sections between the cradle member and the mine tunnel, and a supporting position in which the cradle member is closer to the mine tunnel and supports the tubing section closely adjacent the mine tunnel ceiling and side wall at the intersection thereof, and means for locking the cradle member in the supporting position.

9. A mine ventilation tubing system as set forth in claim 8 wherein said locking means comprises a generally L-shaped brace pivotally mounted on the mounting member, the brace being movable between a release position in which it allows the cradle member to swing freely between its retracted and supporting positions, and a lock position in which the brace engages the cradle member in its supporting position for releasably locking the cradle member in its supporting position.

10. A mine ventilation tubing system as set forth in claim 8 wherein said mounting member comprises a sleeve connected to a roof bolt of a pre-existing ceiling support structure in the mine, an arm slidably receivable through the sleeve and means for releasably fixing the arm relative the sleeve, said cradle member being pivotally attached to the arm such that the cradle member is selectively positionable relative said one side wall.

11. A mine ventilation system comprising a mine tunnel having a ceiling, a floor and side walls extending upwardly from the floor and intersecting the ceiling and mine ventilation tubing system comprising:

a plurality of tubing sections having, in transverse cross section, three sides connected together by three radiused corners, one of said corners having a substantially larger radius than the other two corners;

means mounting the tubing sections in the tunnel with said one corner having the larger radius located closely adjacent the intersection of one of the side walls with the ceiling, a first of said tubing section sides located closely adjacent the ceiling, and a second of said tubing section sides located closely adjacent said one side wall such that the tubing sections are positioned out of the way of equipment travelling or operating in the tunnel.

12. A mine ventilation system as set forth in claim 11 wherein said first side of each tubing section lies in a plane generally perpendicular to a plane including said second side of the tubing section.

13. A mine ventilation tubing system as set forth in claim 12 wherein a third side of the tubing section lies in a plane intersecting the planes of said first and second sides of the tubing section at oblique angles.

14. A mine ventilation tubing system as set forth in claim 13 wherein said mounting means is adapted to mount the tubing section with the plane of said first side extending generally parallel to the ceiling and the plane of said second side extending generally parallel to said one side wall.

15. A mine ventilation tubing system as set forth in claim 14 wherein the tubing sections are made of fiberglass.

16. A mine ventilation system as set forth in claim 11 wherein the contour of the tubing section at said one corner and said first and second sides conforms generally to the shape of the mine tunnel at the intersection of the ceiling and said one side wall.

17. A mine ventilation system as set forth in claim 11 wherein the length of said first ventilation tubing section side is substantially equal to the length of said second ventilation tubing section side.

18. A mine ventilation system as set forth in claim 11 wherein said mounting means comprises cantilever support means mounted on the mine tunnel for supporting the tubing sections in cantilever fashion.

19. A mine ventilation system as set forth in claim 18 wherein said cantilever support means comprises a plurality mounting members fixed to the mine tunnel, and a plurality of cradle members pivotally attached to corresponding mounting members for swinging between a retracted position in which each cradle member is spaced from the intersection of the ceiling and said one side wall to allow positioning of one of the tubing sections between the cradle member and the mine tunnel, and a supporting position in which the cradle member is closer to the mine tunnel and supports the tubing section closely adjacent the mine tunnel ceiling and side wall at the intersection thereof, and means for locking the cradle member in the supporting position.

20. Mine ventilation system as set forth in claim 19 wherein said locking means comprises a generally L-shaped brace pivotally mounted on the mounting member, the brace being movable between a release position in which it allows the cradle member to swing freely between its retracted and supporting positions, and a lock position in which the brace engages the cradle member in its supporting position for holding releasably locking the cradle member in its supporting position.

21. A mine ventilation system as set forth in claim 19 wherein said cantilever support means further comprises a roof bolt mounted on the ceiling of the mine tunnel generally adjacent the intersection, the mounting member being connected to and supported by the roof bolt.

22. A mine ventilation system as set forth in claim 21 wherein said mounting member comprises a sleeve connected to the roof bolt, an arm slidably receivable through the sleeve and means for releasably fixing the arm relative the sleeve, said cradle member being pivotally attached to the arm such that the cradle member is selectively positionable relative said one side wall.

23. A method of installing mine ventilation tubing in a mine tunnel having a ceiling, a floor and side walls extending upwardly from the floor and intersecting the ceiling, the method comprising the steps of:

providing a plurality of tubing sections having, in transverse cross section, three sides connected together by three radiused corners, one of said corners having a substantially larger radius than the other two corners;

mounting the tubing sections in the tunnel with said one corner having the larger radius located closely adjacent the intersection of one of the side walls with the ceiling, a first of said tubing section sides located closely adjacent the ceiling, and a second of said tubing section sides located closely adjacent said one side wall such that the tubing sections are positioned out of the way of equipment travelling or operating in the tunnel.

24. A method as set forth in claim 23 wherein the step of mounting the tubing sections comprises the step of supporting the tubing sections from a location spaced laterally of the tubing section.

* * * * *